US009776830B2

(12) United States Patent
Ooms

(10) Patent No.: US 9,776,830 B2
(45) Date of Patent: Oct. 3, 2017

(54) SEAT FOR A STAIR LIFT

(71) Applicant: Otto Ooms B.V., Bergambacht (NL)

(72) Inventor: Alex Ooms, Bergambacht (NL)

(73) Assignee: Otto Ooms B.V., Bergambacht (NL)

( * ) Notice: Subject to any disclaimer, the term of this patent is extended or adjusted under 35 U.S.C. 154(b) by 0 days.

(21) Appl. No.: 14/778,943

(22) PCT Filed: Mar. 26, 2014

(86) PCT No.: PCT/NL2014/050186
§ 371 (c)(1),
(2) Date: Sep. 21, 2015

(87) PCT Pub. No.: WO2014/158020
PCT Pub. Date: Oct. 2, 2014

(65) Prior Publication Data

US 2016/0075535 A1 Mar. 17, 2016

(30) Foreign Application Priority Data

Mar. 27, 2013 (NL) ..... 2010531

(51) Int. Cl.
*B66B 9/08* (2006.01)
*A61G 5/06* (2006.01)
(Continued)

(52) U.S. Cl.
CPC ..... *B66B 9/08* (2013.01); *A61G 5/061* (2013.01); *A61G 5/10* (2013.01); *A61G 5/12* (2013.01);
(Continued)

(58) Field of Classification Search
CPC ..... B66B 9/08; B66B 9/0853; A61G 5/061; A61G 5/10; A61G 5/12; A61G 2005/125;
(Continued)

(56) References Cited

U.S. PATENT DOCUMENTS 4,913,264 A 4/1990 Voves
5,533,594 A * 7/1996 Tremblay ..... B66B 9/0838 187/201

(Continued)

FOREIGN PATENT DOCUMENTS

DE 202012100417 3/2012
GB 2469093 10/2010

*Primary Examiner* — Philip Gabler
(74) *Attorney, Agent, or Firm* — Marcus C. Dawes; Daniel L. Dawes

(57) ABSTRACT

A seat for a stair lift, which seat is provided with a fall protection device comprising at least one elongate safety bar which is movable between an open position and a closed position, in which open position a person can freely move into and out of the seat, wherein the safety bar is movably connected to an elongate support that is stationarily connected to the seat, which support extends on a side of the seat, wherein the fall protection device is designed so that in the open position the safety bar takes up a rearward position, in which it extends substantially parallel to and beside the support, and that in the closed position the safety bar takes up a forwardly moved (along the support), inwardly pivoted or rotated position, in which it extends from the front end of the support, in which position it can be locked, such that a person cannot fall out of the seat.

14 Claims, 5 Drawing Sheets

(51) Int. Cl.
*A61G 5/10* (2006.01)
*A61G 5/12* (2006.01)

(52) U.S. Cl.
CPC ..... *A61G 5/125* (2016.11); *A61G 5/128* (2016.11); *B66B 9/0853* (2013.01)

(58) Field of Classification Search
CPC .... A61G 2005/128; A47C 7/54; A47C 7/543; A47C 7/546; A63G 7/00; B60R 21/00
See application file for complete search history.

(56) References Cited

U.S. PATENT DOCUMENTS

| | | | | |
|---|---|---|---|---|
| 6,074,012 | A | 6/2000 | Wu | |
| 7,537,069 | B2 * | 5/2009 | Kramer | A47C 7/62 180/21 |
| 8,550,215 | B2 * | 10/2013 | Linton | B66B 9/0853 187/201 |
| 2002/0074189 | A1 * | 6/2002 | Hester | B66B 9/08 187/201 |
| 2006/0185937 | A1 * | 8/2006 | Caroen | B66B 9/0853 187/201 |
| 2015/0034423 | A1 * | 2/2015 | Ooms | B66B 9/0846 187/201 |
| 2015/0107939 | A1 * | 4/2015 | Ooms | B66B 9/0853 187/201 |

* cited by examiner

SEAT FOR A STAIR LIFT

The present invention relates to a seat for a stair lift, which seat is provided with a fall protection device comprising at least one elongate safety bar which is movable between an open position and a closed position, in which open position a person can freely move into and out of the seat, and in which closed position the safety bar prevents a person from falling out of the seat.

The object of the invention is to provide a protective device in the form of a safety bar, which bar opens and closes in an efficient and safe manner, which takes up little space and/or which gives the seat an aesthetic look.

In order to achieve that object, the safety bar is according to the invention movably connected to an elongate support that is stationarily connected to the seat, which support extends on a side of the seat, wherein the fall protection device is designed so that in the open position the safety bar takes up a rearward position, in which it extends substantially parallel to and beside the support, and that in the closed position the safety bar takes up a forwardly moved (along the support), inwardly pivoted or rotated position, in which it extends from the front end of the support, in which position it can be locked, such that a person cannot fall out of the seat.

The safety bar is preferably connected to the support in such a manner that the safety bar forcedly pivots inward upon being moved forward.

Preferably, the safety bar is pivotally connected to the support near its rear end, being translatable in the longitudinal direction thereof; wherein the support is provided with a key near its front end, and wherein the safety bar is provided with a keyway which, viewed from above, extends diagonally in the safety bar, in which keyway the key engages; or wherein the safety bar is provided with a key near the pivot, and the support is provided with a keyway which, viewed from above, extends diagonally in the support, in which keyway the key engages; such that the safety bar forcedly pivots inward upon being moved forward.

The safety bar is preferably connected to the support by means of a pivot element, which is on the one hand mounted on the support in such a way that it can move forward and rearward thereon, and which is on the other hand pivotally connected to the rear end of the safety bar.

Preferably, the safety bar can be automatically locked in position by means of a pawl near the rear end, which can be pushed into a recess in the pivot element by a spring element, so that the safety bar is locked against rotation. The safety bar can furthermore preferably be unlocked by means of a control button at the front end of the safety bar, which is connected to the pawl, such that the pawl can be pushed into and out of the recess in the pivot element against spring force by the control button, as a result of which the safety bar is no longer locked against rotation.

The pivot element is preferably provided with an armrest that extends rearward from the pivot point.

The pivot element and the safety bar preferably enclose the support at least substantially.

Preferably, the seat further comprises a footrest, which is movable between a folded-up position and a folded-down position by means of a driven moving mechanism, wherein the moving mechanism is designed so that the footrest is automatically moved to the folded-down position when the safety bar is being or has been moved to the closed position. In an alternative embodiment, the moving mechanism of the footrest is designed to be operated by control means, which are preferably provided on the safety bar, for moving the footrest to the folded-down position.

Preferably, the seat further comprises control means for controlling the drive means so as to cause a frame on which the seat is mounted to move along a rail that is installed along a staircase, wherein the control means are provided on the safety bar.

In the preferred embodiment, the fall protection device comprises two of the aforesaid safety bars, one on each side of the seat.

Preferably, the fall protection device also forms an armrest of the seat.

Preferably, the fall protection device can be swung up in that the rear end of the support is pivotally connected to the seat about a horizontal axis.

The control means are preferably located near the front end of the safety bar.

In an alternative embodiment, the seat further comprises control means for controlling the drive means so as to cause a frame on which the seat is mounted to move along a rail that is installed along a staircase, wherein the control means comprise the safety bar or the safety bars, and wherein movement such as pivoting of the safety bar or safety bars with respect to the support by a person seated on the seat starts and stops said movement of the frame.

The invention also relates to a stair lift comprising a frame provided with engaging means which are designed to engage the rail that is installed along a staircase and drive means which are designed to move the seat along the rail, and a seat that is mounted on the frame.

The invention will now be explained in more detail with reference to exemplary embodiments shown in the figures, in which.

Figure 1B:
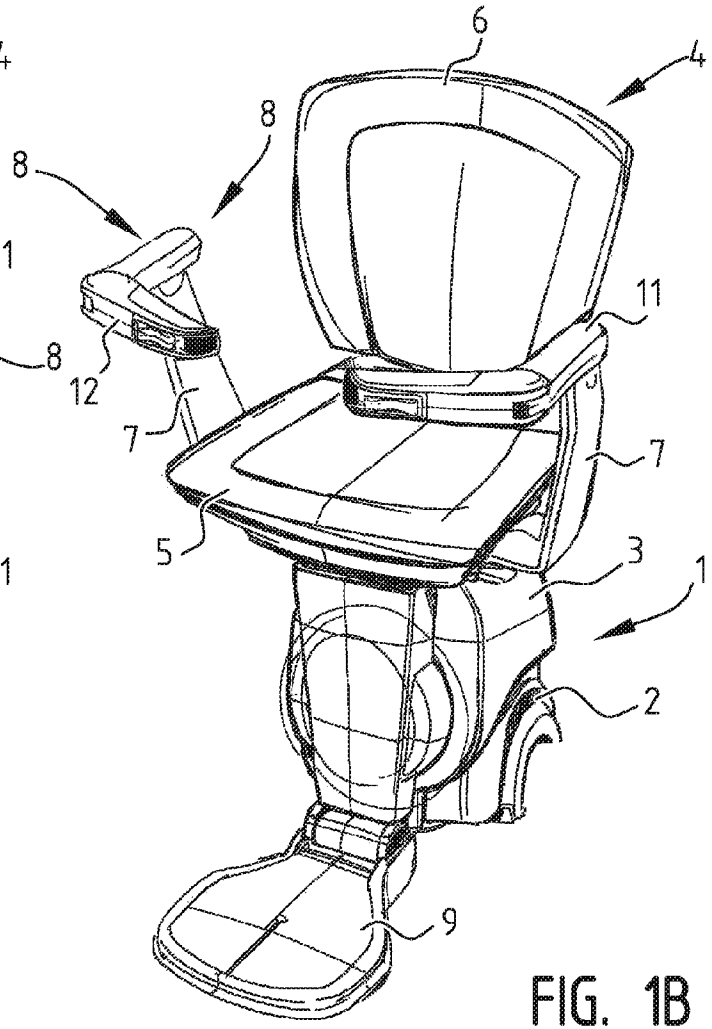
FIGS. 1A and 1B are perspective views of the seat according to the invention provided with a fall protection device shown in an open position and a closed position, respectively.
Figure 1A:
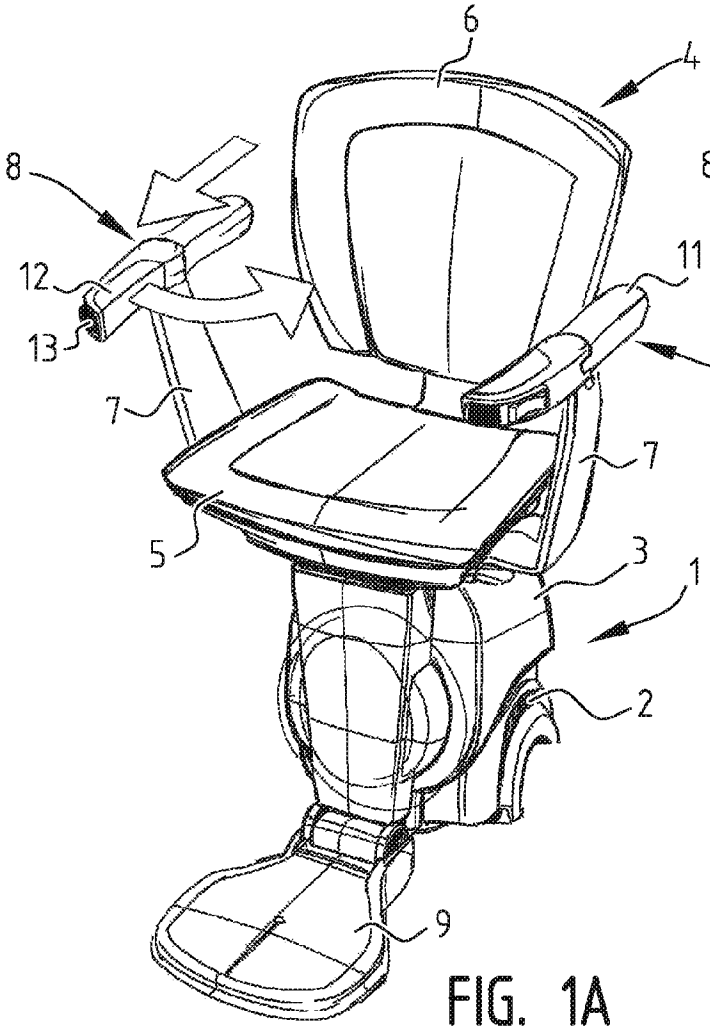

According to FIGS. 1A, 1B, a stair lift system which can be installed at a staircase comprises a rail (not shown), a frame 1 which is designed to move along the rail and which consists of two parts, a part 2 of which engages the rail and another part 3 of which can be rotated with respect to the first part so as to maintain the seat 4 mounted thereon in an upright position.

The seat 4 comprises a seat part 5 and a backrest 6. Support brackets 7 are fixed to either side of the seat part 5, to which support brackets fall protection device 8 is connected, which fall protection device is so configured and mounted at such a level that it also functions as an armrest.

The fall protection device 8 comprises a translatable pivot element 11 on both sides and an inwardly pivotable safety bar 12 connected thereto. In the rearward position, the safety bars 12 extend beside the person on the seat in the form of two armrests. When the safety bar 12 is moved forward, said armrests are forcedly pivoted inward, such that they extend obliquely in front of the person, preventing him/her from falling out of the seat. The safety bars 12 are locked in both extreme positions and can be unlocked by means of control buttons 13. Near the control buttons 13, electronic control buttons are furthermore provided for controlling the stair lift. When for example the control button 13 on the left-hand bar is operated, the seat will move down, when the control button 13 on the right-hand bar is operated, the seat will move up (or vice versa, depending on the way the stair lift is installed on the staircase).

The seat furthermore comprises a folding footrest 9, which is electrically operated. The driving mechanism is electronically connected to the fall protection device, such that the footrest is folded down when the safety bars are closed, and vice versa.

Figure 2A:
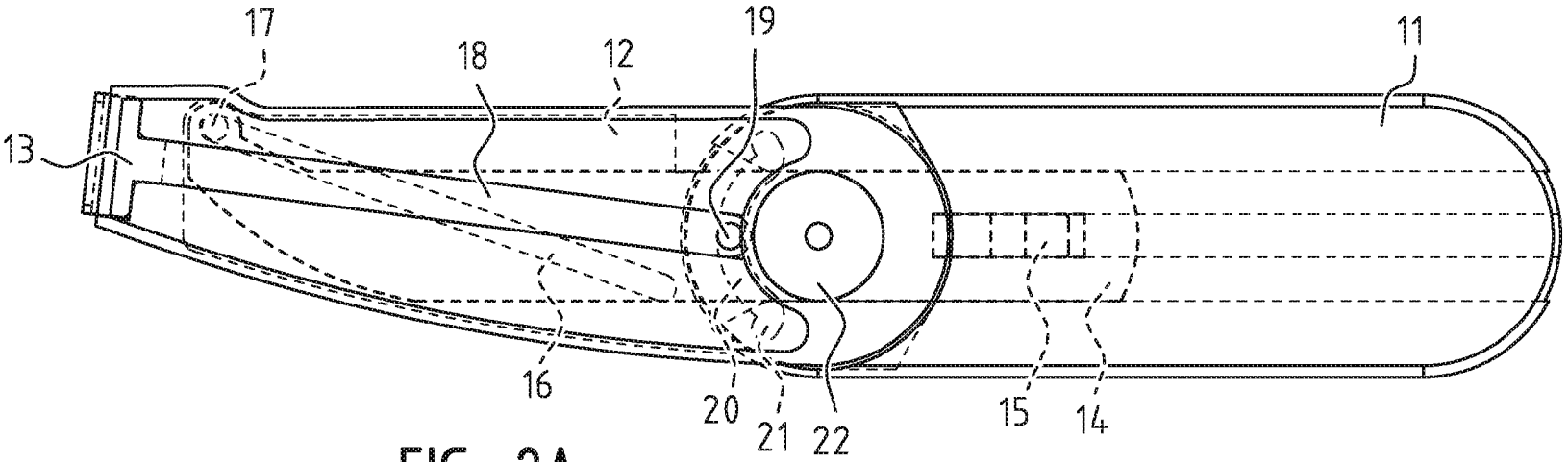
FIGS. 2A and 2B are a top plan view and a side view, respectively, of a fall protection device of the seat of FIGS. 1A and 1B in the open position thereof.
Figure 2B:
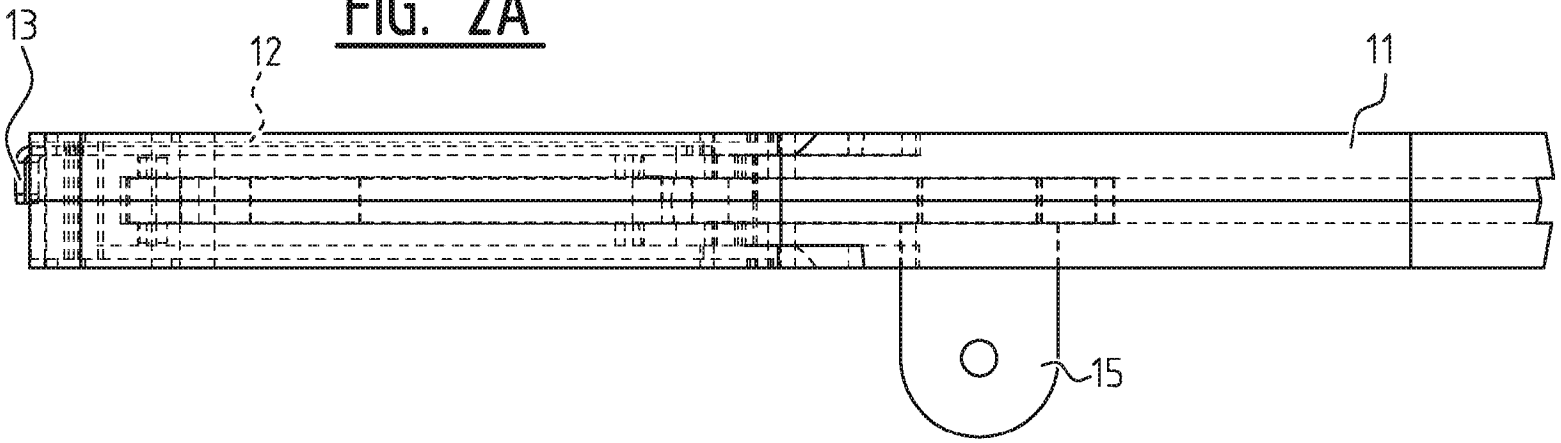
Figure 3A:
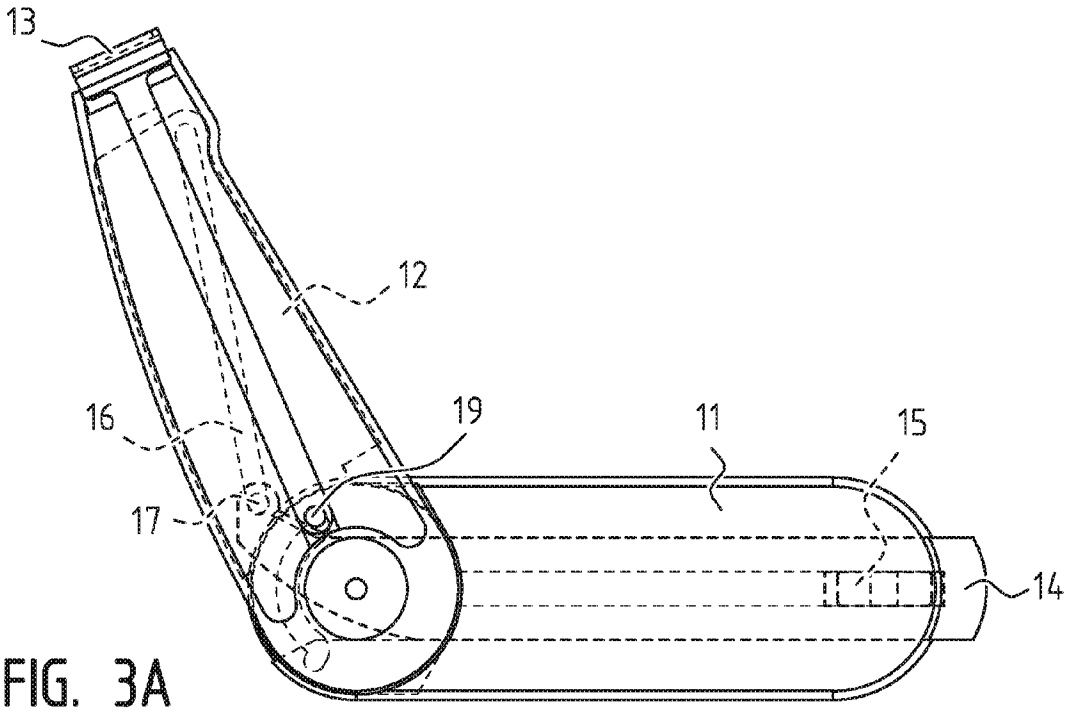
FIGS. 3A and 3B are a top plan view and a side view, respectively, of a fall protection device of the seat of FIGS. 1A and 1B in the closed position thereof.
Figure 3B:
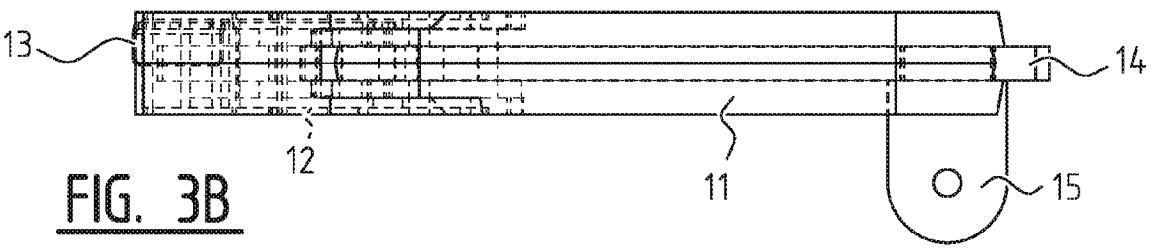
Figure 4:
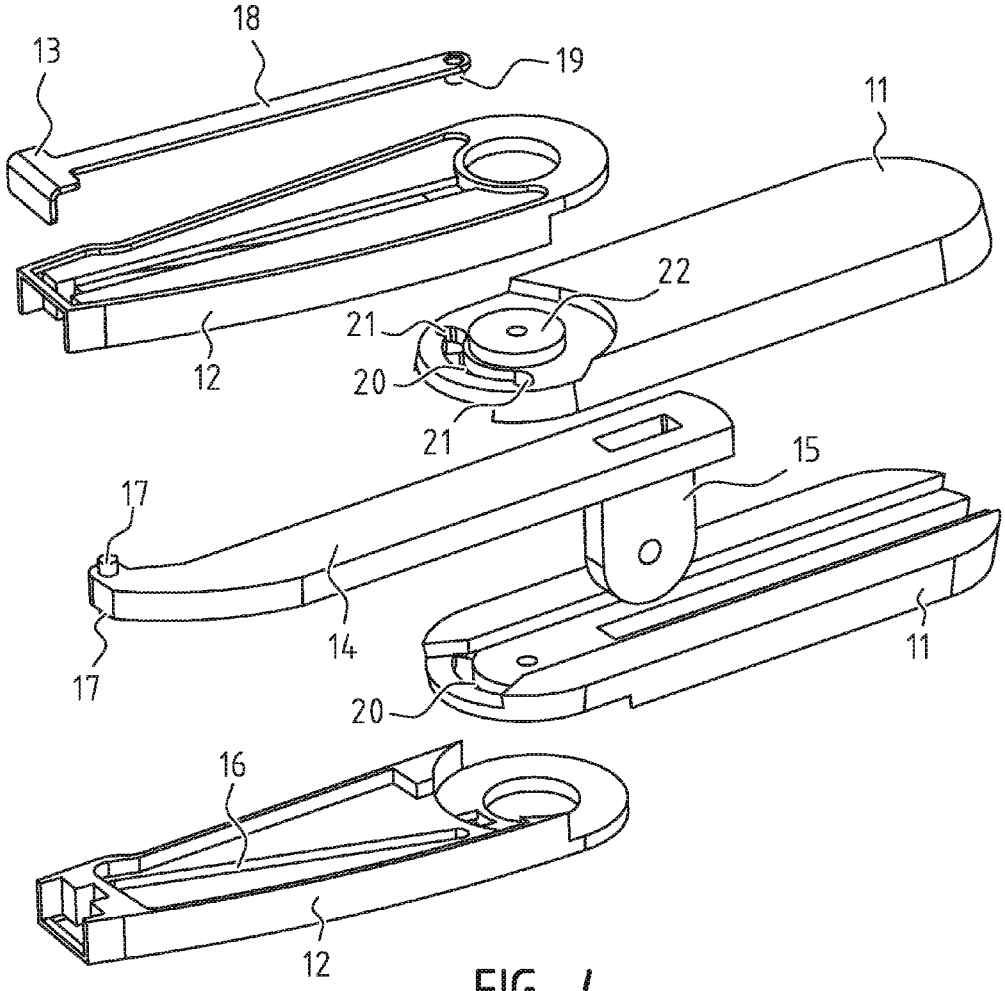
FIG. 4 is an exploded perspective view of a fall protection device of the seat of FIGS. 1A and 1B.

In FIGS. 2-4 the protection device 8 is shown in more detail. An elongate, substantially plank-shaped support 14 is provided with a downwardly projecting mounting part 15, which is pivotally connected to the support bracket 7. This enables the support 14 to move between a folded-up, vertical storage position and a folded-down, horizontal operative position.

Around the support 14 there is movably mounted the pivot element 11, which is to that end provided with an elongate through recess, in which the support can move. The lower half of the pivot element 11 is provided with a slot, through which the mounting part 15 can extend upon forward movement of the safety bar 12.

At the front side, the pivot element 11 is provided with two upwardly and downwardly projecting pivots 22, to which the rear end of the safety bar 12 is pivotally connected. The safety bar 12 is hollow, so that it can move over the end of the support 14. Parallel keyways 16 are provided in the inner wall of the safety bar, both at the upper side and the bottom side thereof, which keyways extend diagonally. Near the pivot element 11, the keyways 16 are disposed further to the outer side of the seat; at the front end of the safety bar 12 the keyways 16 are disposed further to the inner side of the seat.

At the front end of the support, which inclines slightly toward the inner side of the seat, two keys 17 are present at the upper side and the bottom side of the support, which keys slip into the keyways 16. As a result of this construction, the safety bars 12 are forced to pivot inward upon being moved forward.

Figure 5:
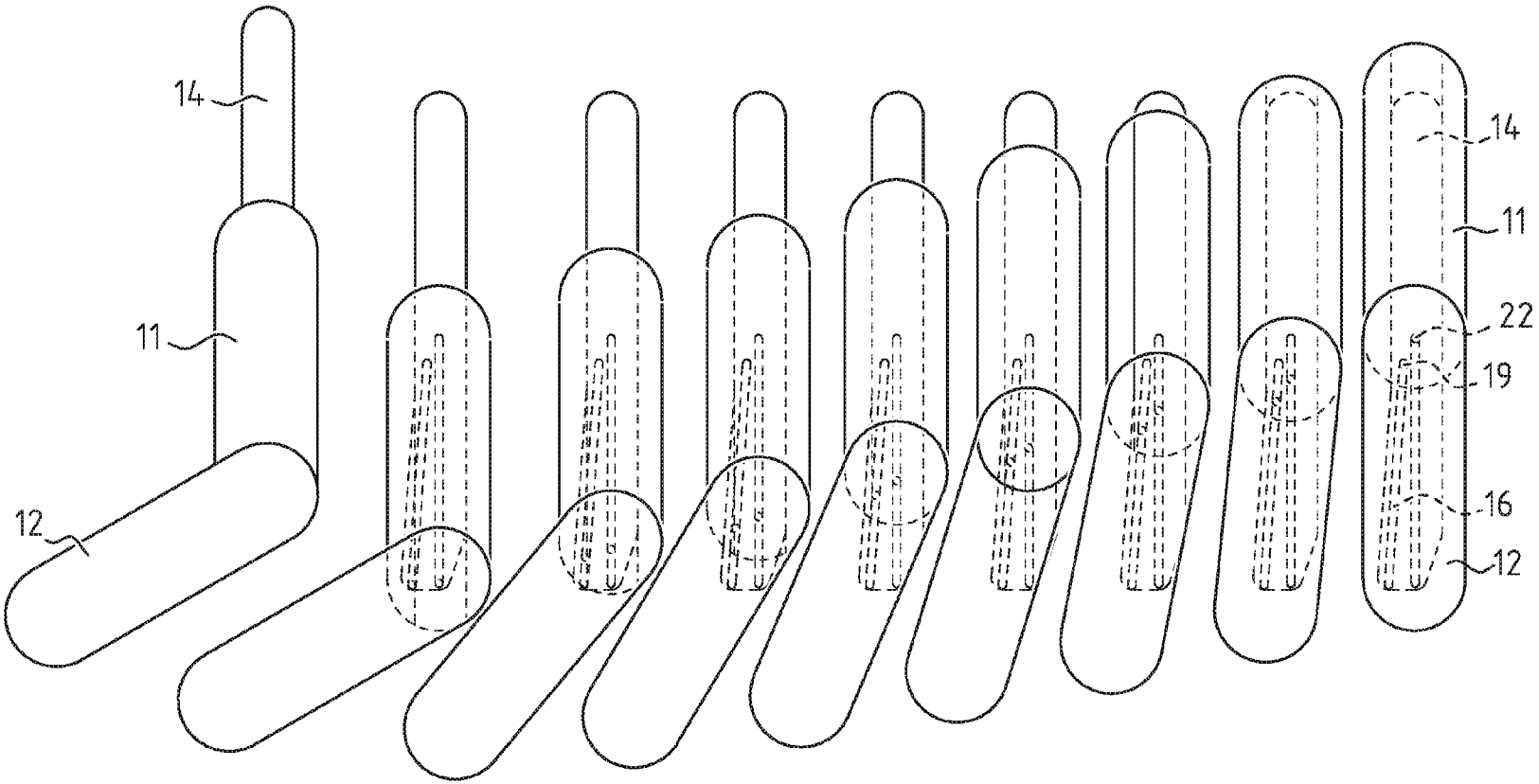
FIG. 5 schematically shows an alternative embodiment of a fall protection device in various positions thereof.

This principle is schematically shown in a slightly different, equivalent embodiment in FIG. 5, in which embodiment it is not the inner wall of the safety bar 12 which is provided with the keyways 16 but rather the support 14 which is provided with one or more keyways 16. The key or keys 17 is/are in that case provided on the safety bar, at a small distance from the pivots 22.

In order to be able to lock the safety bar in position, the control button 13 is connected, by means of a rod 18, to a pawl 19 which extends near the pivots 22 and into a slot 20 having the shape of a segment of a circle, which extends around said pawl. The rod is capable of movement in a recess in the wall of the safety bar and is guided by said recess. Recesses 21 extending transversely to the slot 20 are provided at both ends of the slot 20, which correspond to the two extreme pivoted positions of the safety bar 12, into which recesses the pawl 19 is pulled by spring means (not shown), as shown in FIGS. 3A and 3B, so that the safety bar 12 is prevented from pivoting back. The locking engagement is released by depressing the control button 13.

The invention has thus been described by means of preferred embodiments. It should be understood, however, that the present description is mainly illustrative. Various details of the structure and function have been presented, but modifications which are made thereto and which are fully extended by the general meaning of the terminology in which the appended claims are worded are to be considered to fall within the principle of the present invention. The description and the drawings are to be used to interpret the claims. The claims must not be interpreted such that the scope of the protection sought is to be regarded as being defined by the strict, literal meaning of the words used in the claims, in which the description and the drawings would only be used to eliminate any ambiguity that may be found in the claims. To determine the scope of the protection sought by the claims, each and every element that is equivalent to an element specified therein must be suitably considered.

The invention claimed is:

1. A seat for a stair lift, which seat comprises:

a back rest extending along a back side thereof and two elongate armrest supports which are each connected to the seat and which extend along the lateral sides thereof; and a fall protection device comprising at least one elongate safety bar movably connected to at least one of said two armrest supports which is movable between an open position and a closed position, wherein when the said fall protection device is in the open position the safety bar extends substantially parallel to and beside the armrest support such that a person can freely move into and out of the seat, wherein when the said fall protection device is in the closed position the safety bar is inwardly pivoted or rotated from a front end of the armrest support and along a front end of the seat, wherein said fall protection device is provided with a lock to lock the safety bar in said closed position in order to help prevent a person from falling out of the seat, wherein the safety bar is pivotally connected to the armrest support near its rear end, being translatable in the longitudinal direction thereof;

wherein the armrest support is provided with a key near its front end, and wherein the safety bar is provided with a keyway which, viewed from above, extends diagonally in the safety bar, in which keyway the key engages; or wherein the safety bar is provided with a key near the pivot, and the support is provided with a keyway which, viewed from above, extends diagonally in the support, in which keyway the key engages such that the safety bar is constrained to pivot inward upon being moved forward.

2. A seat according to claim 1, wherein the safety bar is connected to the armrest support in such a manner that the safety bar is constrained to pivot inward upon being moved forward along the armrest support.

3. A seat for a stair lift, which seat comprises:

a back rest extending along a back side thereof and two elongate armrest supports which are each connected to the seat and which extend along the lateral sides thereof; and a fall protection device comprising at least one elongate safety bar movably connected to at least one of said two armrest supports which is movable between an open position and a closed position, wherein when the said fall protection device is in the open position the safety bar extends substantially parallel to and beside the armrest support such that a person can freely move into and out of the seat, wherein when the said fall protection device is in the closed position the safety bar is inwardly pivoted or rotated from a front end of the armrest support and along a front end of the seat, wherein said fall protection device is provided with a lock to lock the safety bar in said closed position in order to help prevent a person from falling out of the seat, and wherein the safety bar is connected to the armrest support by means of a pivot element, which is mounted on the armrest support in such a way that it can move forward and rearward thereon, and which is also pivotally connected to the rear end of the safety bar.

4. A seat according to claim 3, wherein the pivot element is provided with an armrest that extends rearward from the pivot point.

5. A seat according to claim 3, wherein the pivot element and the safety bar enclose the support at least substantially.

6. A seat for a stair lift, which seat comprises:

a back rest extending along a back side thereof and two elongate armrest supports which are each connected to the seat and which extend along the lateral sides thereof; and a fall protection device comprising at least one elongate safety bar movably connected to at least one of said two armrest supports which is movable between an open position and a closed position, wherein when the said fall protection device is in the open position the safety bar extends substantially parallel to and beside the armrest support such that a person can freely move into and out of the seat, wherein when the said fall protection device is in the closed position the safety bar is inwardly pivoted or rotated from a front end of the armrest support and along a front end of the seat, wherein said fall protection device is provided with a lock to lock the safety bar in said closed position in order to help prevent a person from falling out of the seat, and wherein the safety bar can be automatically locked in position by means of a pawl near the rear end, which can be pushed into a recess in the pivot element by a spring element, so that the safety bar is locked against rotation.

7. A seat according to claim 6, wherein the safety bar can be unlocked by means of a control button at the front end of the safety bar, which is connected to the pawl, such that the pawl can be pushed into and out of the recess in the pivot element against spring force by the control button, as a result of which the safety bar is no longer locked against rotation.

8. A seat according to claim 1, wherein the seat further comprises a footrest, which is movable between a folded-up position and a folded-down position by means of a driven moving mechanism, and wherein the moving mechanism is designed so that the footrest is automatically moved to the folded-down position when the safety bar is being or has been moved to the closed position.

9. A seat according to claim 1, wherein the seat further comprises control means for controlling the drive means so as to cause a frame on which the seat is mounted to move along a rail that is installed along a staircase, wherein the control means are provided on the safety bar.

10. A seat according to claim 9, wherein the control means are located near the front end of the safety bar.

11. A seat according to claim 1, wherein the fall protection device comprises two of the aforesaid safety bars, one on each side of the seat.

12. A seat for a stair lift, which seat comprises:

a back rest extending along a back side thereof and two elongate armrest supports which are each connected to the seat and which extend along the lateral sides thereof; and a fall protection device comprising at least one elongate safety bar movably connected to at least one of said two armrest supports which is movable between an open position and a closed position, wherein when the said fall protection device is in the open position the safety bar extends substantially parallel to and beside the armrest support such that a person can freely move into and out of the seat, wherein when the said fall protection device is in the closed position the safety bar is inwardly pivoted or rotated from a front end of the armrest support and along a front end of the seat, wherein said fall protection device is provided with a lock to lock the safety bar in said closed position in order to help prevent a person from falling out of the seat, and wherein the fall protection device can be swung up in that the rear end of the armrest support is pivotally connected to the seat about a horizontal axis.

13. A seat according to claim 1, wherein the seat further comprises control means for controlling the drive means so as to cause a frame on which the seat is mounted to move along a rail that is installed along a staircase, wherein the control means comprise the safety bar or the safety bars, and wherein movement such as pivoting of the safety bar or safety bars with respect to the armrest support by a person seated on the seat starts and stops said movement of the frame.

14. A stair lift comprising a seat according to claim 1 that is mounted on a frame, the frame being provided with engaging means which are configured to engage a rail that is installed along a staircase and drive means which are configured to move the seat along the rail.

* * * * *